US009954315B2

(12) United States Patent
Siebens et al.

(10) Patent No.: US 9,954,315 B2
(45) Date of Patent: Apr. 24, 2018

(54) GROUNDING LINK FOR ELECTRICAL CONNECTOR MECHANISM

(71) Applicant: Thomas & Betts International, LLC, Wilmington, DE (US)

(72) Inventors: Larry N. Siebens, Asbury, NJ (US); Alan D. Borgstrom, Hackettstown, NJ (US)

(73) Assignee: Thomas & Betts International LLC, Wilmington, DE (US)

( * ) Notice: Subject to any disclaimer, the term of this patent is extended or adjusted under 35 U.S.C. 154(b) by 46 days.

(21) Appl. No.: 14/939,168

(22) Filed: Nov. 12, 2015

(65) Prior Publication Data

US 2016/0141801 A1 May 19, 2016

Related U.S. Application Data

(60) Provisional application No. 62/080,496, filed on Nov. 17, 2014.

(51) Int. Cl.
*H01R 13/207* (2006.01)
*H01R 13/447* (2006.01)
(Continued)

(52) U.S. Cl.
CPC ..... *H01R 13/648* (2013.01); *H01R 13/53* (2013.01); *H01R 31/02* (2013.01); *H01R 43/16* (2013.01);
(Continued)

(58) Field of Classification Search
CPC .... H01R 13/53; H01R 13/207; H01R 13/447; H01R 13/648; H01R 13/6599;
(Continued)

(56) References Cited

U.S. PATENT DOCUMENTS 3,959,869 A 6/1976 Wyman et al.
4,203,641 A * 5/1980 Siebens ..... H01R 13/53 174/152 R
(Continued)

FOREIGN PATENT DOCUMENTS

CA 2130506 C 4/2004
CA 2703275 A1 5/2009
(Continued)

*Primary Examiner* — Edwin A. Leon
*Assistant Examiner* — Oscar Jimenez
(74) *Attorney, Agent, or Firm* — Taft Stettinius & Hollister LLP

(57) ABSTRACT

A grounding link for use with an elbow-type power cable electrical connector. The grounding link includes a bushing interface portion, a cap receiving portion, and a tap portion, wherein the grounding link further includes a grounding element extending between the bushing interface portion and a cap receiving portion, and wherein the bushing interface portion of the grounding link is configured for insertion into a bore in elbow-type power cable electrical connector. The grounding element includes an exposed portion projecting above a surface of the grounding link, wherein the exposed portion of the grounding element is configured for attachment by a grounded hot line clamp to ground the electrical connector assembly. The tap portion is configured for receipt of a second elbow connector to conductively couple the second elbow connector to the elbow-type power cable electrical connector.

19 Claims, 11 Drawing Sheets

(51) Int. Cl.

| | |
|---|---|
| ***H01R 13/53*** | (2006.01) |
| ***H01R 13/648*** | (2006.01) |
| ***H01R 13/6599*** | (2011.01) |
| ***H01R 43/16*** | (2006.01) |
| ***H01R 31/02*** | (2006.01) |
| ***H01R 4/56*** | (2006.01) |
| ***H01R 11/15*** | (2006.01) |
| *H01R 101/00* | (2006.01) |

(52) U.S. Cl.

CPC ..... *H01R 4/56* (2013.01); *H01R 11/15* (2013.01); *H01R 13/207* (2013.01); *H01R 13/447* (2013.01); *H01R 13/6599* (2013.01); *H01R 2101/00* (2013.01)

(58) Field of Classification Search

CPC ..... H01R 31/02; H01R 43/16; H01R 4/56; H01R 11/15; H01R 2101/00; Y10S 439/321

USPC ..... 439/181–188, 921, 582, 507, 784, 805, 439/135, 148, 843

See application file for complete search history.

(56) References Cited

U.S. PATENT DOCUMENTS

| | | | | |
|---|---|---|---|---|
| 4,787,855 | A | 11/1988 | Finke | |
| 4,799,895 | A * | 1/1989 | Borgstrom | H01R 13/53 439/183 |
| 4,955,823 | A * | 9/1990 | Luzzi | H01R 13/53 439/507 |
| 5,427,538 | A | 6/1995 | Knapp et al. | |
| 5,646,370 | A | 7/1997 | Perkins | |
| 5,829,992 | A | 11/1998 | Merker et al. | |
| 6,042,407 | A * | 3/2000 | Scull | H01R 13/53 439/181 |
| 6,075,209 | A | 6/2000 | Luzzi | |
| D459,305 | S | 6/2002 | Malin | |
| D459,306 | S | 6/2002 | Malin | |
| 7,198,495 | B1 | 4/2007 | Youtsey | |
| 7,501,598 | B2 * | 3/2009 | Stepniak | H01H 9/16 218/120 |
| 7,540,758 | B2 | 6/2009 | Ho | |
| 7,695,291 | B2 | 4/2010 | Hughes et al. | |
| 7,841,897 | B2 | 11/2010 | Blake et al. | |
| 7,891,999 | B2 | 2/2011 | Hughes et al. | |
| 7,901,228 | B2 | 2/2011 | Hughes et al. | |
| 7,972,155 | B1 * | 7/2011 | Siebens | H01R 13/53 439/181 |
| 8,368,405 | B2 * | 2/2013 | Siebens | G01R 1/0416 324/538 |
| 8,408,925 | B2 * | 4/2013 | Borgstrom | H01R 3/00 439/181 |
| 9,350,103 | B2 * | 5/2016 | Siebens | H01R 13/207 |
| 2003/0027452 | A1 | 2/2003 | Jazowski | |
| 2012/0021650 | A1 * | 1/2012 | Borgstrom | H01R 13/5216 439/626 |
| 2014/0008169 | A1 * | 1/2014 | Kawasaki | B61G 5/10 191/59.1 |
| 2014/0024241 | A1 * | 1/2014 | Siebens | H01R 13/53 439/310 |
| 2014/0057467 | A1 * | 2/2014 | Siebens | H01R 25/006 439/121 |
| 2015/0380880 | A1 * | 12/2015 | Siebens | H01R 9/18 439/529 |

FOREIGN PATENT DOCUMENTS

| | | |
|---|---|---|
| CA | 2590954 C | 7/2011 |
| CA | 2821465 A1 | 1/2014 |
| EP | 2688153 A2 | 1/2014 |

* cited by examiner

GROUNDING LINK FOR ELECTRICAL CONNECTOR MECHANISM

CROSS-REFERENCE TO RELATED APPLICATION

This application claims priority under 35. U.S.C. § 119, based on U.S. Provisional Patent Application No. 62/080,496 filed Nov. 17, 2014, the disclosure of which is hereby incorporated by reference herein.

BACKGROUND OF THE INVENTION

The present invention relates to electrical cable connectors, such as loadbreak connectors and deadbreak connectors. More particularly, aspects described herein relate to an electrical cable connector, such as a power cable elbow or T-connector connected to electrical switchgear assembly.

Loadbreak and deadbreak connectors used in conjunction with 15 through 35 KV switchgear generally include power cable elbow connectors having one end adapted for receiving a power cable and another end adapted for receiving a loadbreak/deadbreak bushing insert or other switchgear device. The end adapted for receiving the bushing insert generally includes an elbow cuff for providing an interference fit with a molded flange on the bushing insert.

In some implementations, the elbow connector may include a second opening formed opposite to the bushing insert opening for facilitating connection of the elbow connector to the bushing and to provide conductive access to the power cable by other devices, such as a surge arrestor, a tap plug, an additional elbow connector, etc.

In still further implementations, utility companies may use reducing tap plugs with the second elbow opening to provide, for example, a 200 ampere (amp) interface to an existing 600 amp system. When isolating and grounding the system, a 200 amp grounding elbow is installed on the reducing tap plug. Unfortunately, 200 amp grounding elbows are only rated for a momentary fault current of 10 kiloamps, while 600 amp systems may require momentary fault currents of up to 25 kiloamps.

DETAILED DESCRIPTION OF THE PREFERRED EMBODIMENTS

The following detailed description refers to the accompanying drawings. The same reference numbers in different drawings may identify the same or similar elements.

Figure 1A:
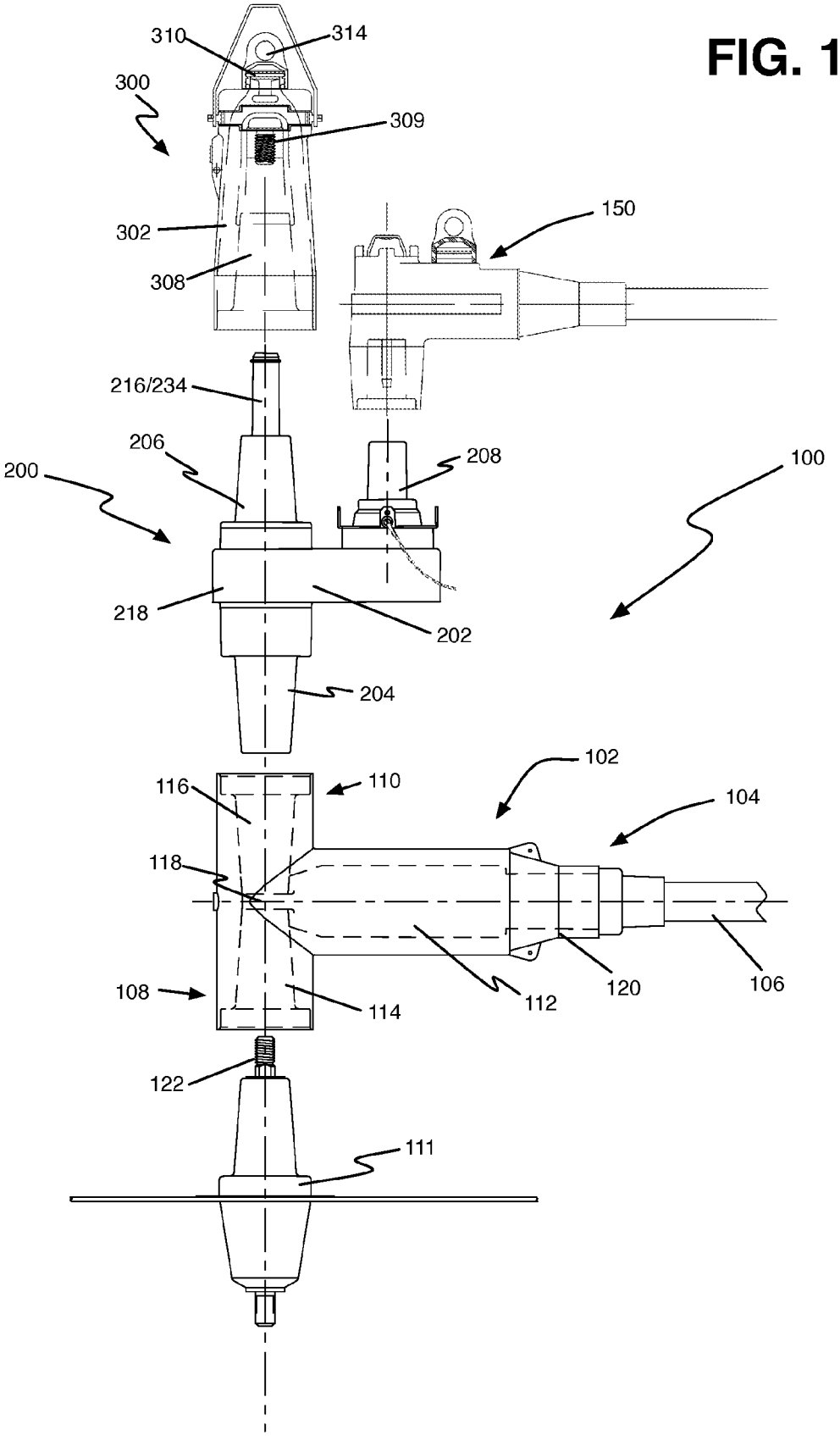
FIG. 1A is a schematic, exploded side view illustrating a power cable electrical connector and grounding link consistent with implementations described herein.
Figure 1B:
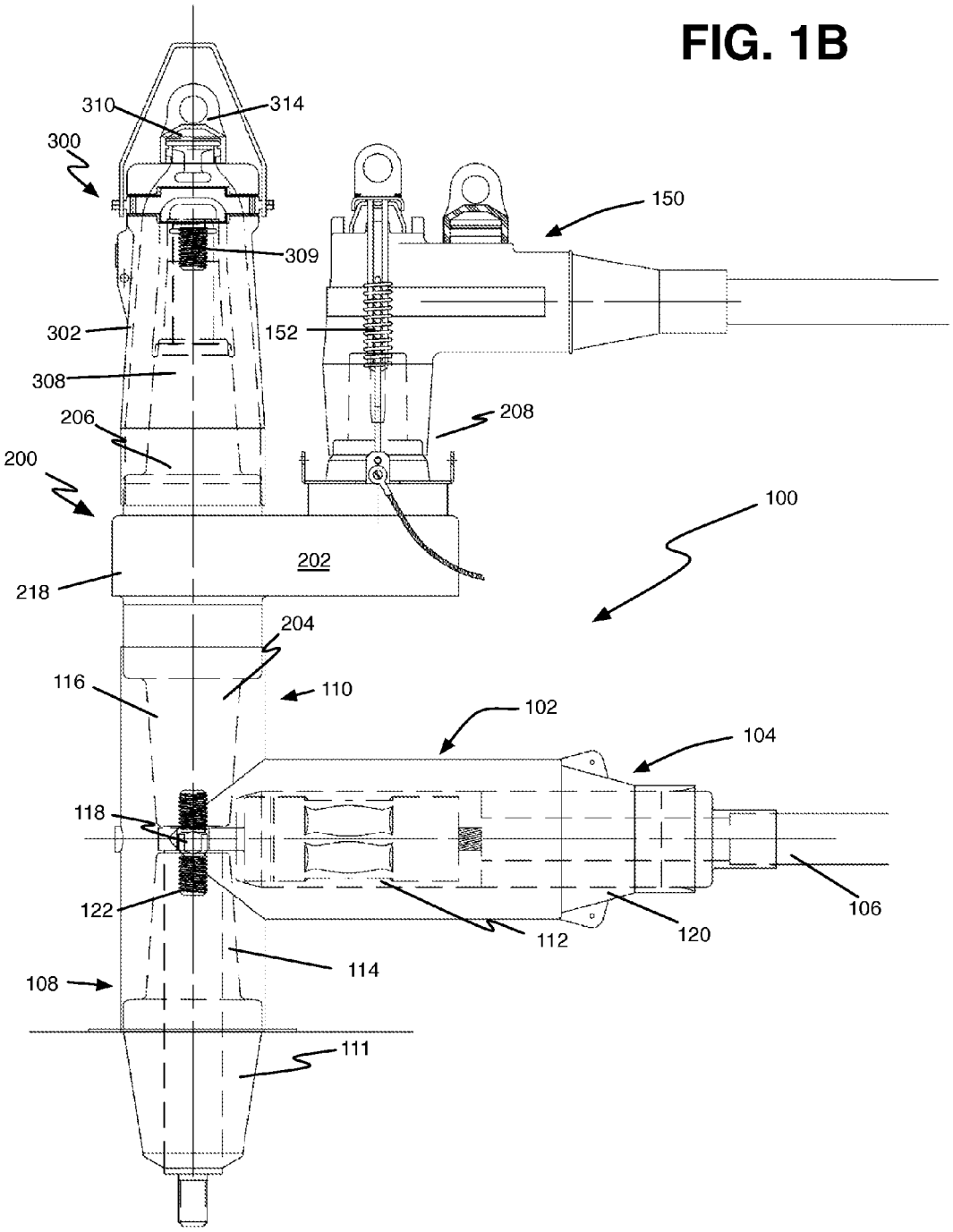
FIG. 1B is a schematic side view of the power cable elbow connector and grounding link of FIG. 1A in an assembled configuration.
Figure 1C:
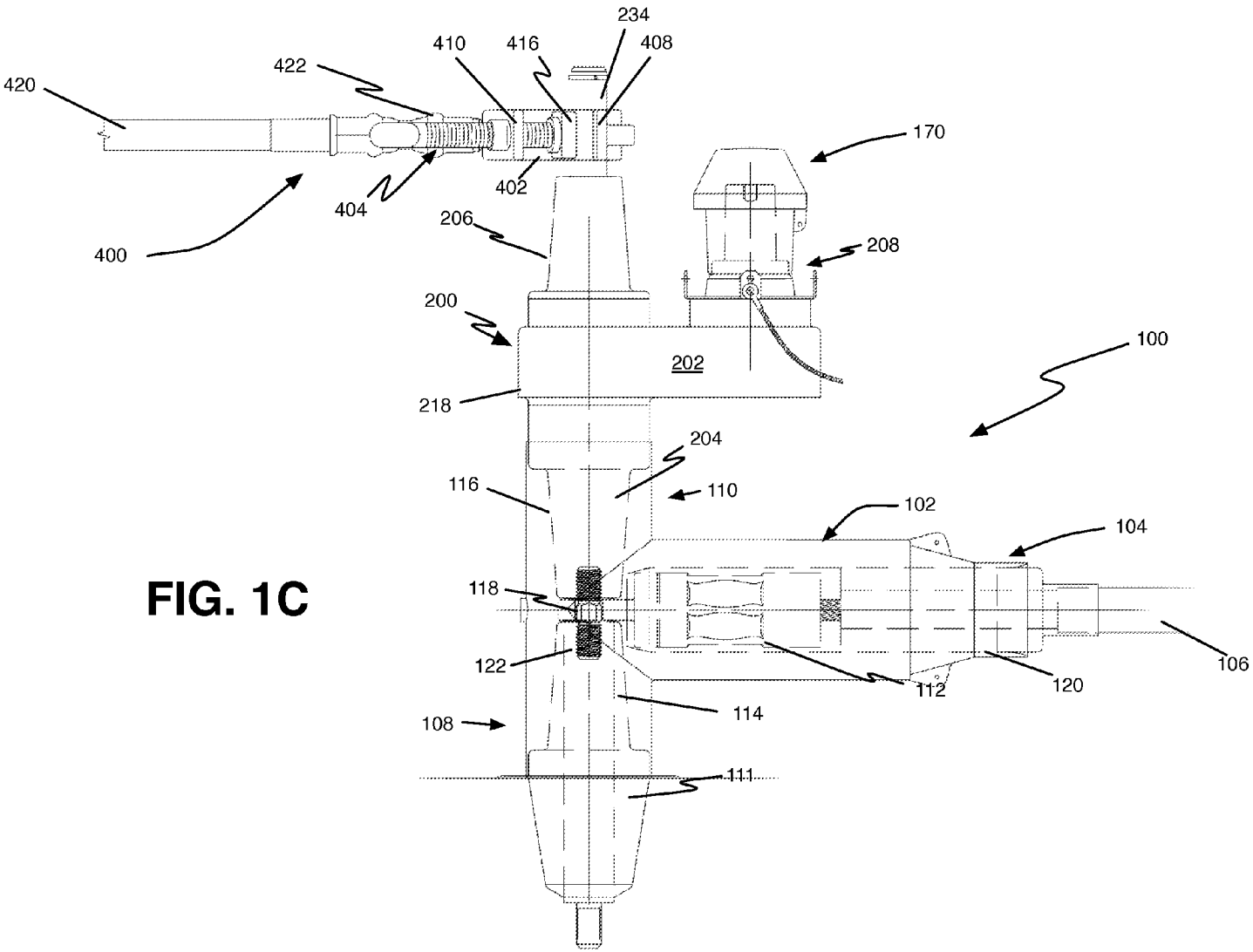
FIG. 1C is a schematic side view of the power cable elbow connector and grounding link of FIG. 1A in another assembled configuration.

FIG. 1A is a schematic exploded side view of a power cable elbow connector assembly 100 consistent with implementations described herein, e.g., a 600 amp elbow assembly. FIG. 1B is a schematic side view of the power cable elbow connector assembly 100 in a first assembled configuration. FIG. 1C is a schematic side view of the power cable elbow connector assembly 100 in a second assembled configuration. As shown, power cable elbow connector assembly 100 may include a main housing body 102 that includes a conductor receiving end 104 for receiving a power cable 106 therein and first and second T-ends 108/110 that include openings for receiving an equipment bushing, such as a deadbreak or loadbreak transformer bushing 111 or other high or medium voltage. Consistent with implementations described herein, second T-end 110 may be configured to receive a grounding link 200 described in additional detail below.

As shown, conductor receiving end 104 may extend along a main axis of assembly 100 and may include a bore 112 extending therethrough. First and second T-ends 108/110 may project substantially perpendicularly from conductor receiving end 104 in opposing directions from one another. First and second T-ends 108/110 may include bores 114/116, respectively, formed therethrough for receiving equipment, bushings, and/or plugs. A contact area 118 may be formed at the confluence of bores 112, 114, and 116.

Power cable elbow connector assembly 100 may include an electrically conductive outer shield 120 formed from, for example, a conductive peroxide-cured synthetic rubber, commonly referred to as EPDM (ethylene-propylene-dienemonomer). Within shield 120, power cable elbow connector assembly 100 may include an insulative inner housing (not shown in the figures), typically molded from an insulative rubber or epoxy material, and a conductive or semi-conductive insert that surrounds the connection portion of power cable 106.

As shown in FIG. 1A, bushing 111 may include a stud portion 122 projecting axially therefrom. During assembly of elbow connector 100 onto bushing 111, as shown in FIG. 1B, stud portion 122 of bushing 111 is received into contact area 118 and extend through an opening in a spade portion coupled to power cable 106 (not shown).

Consistent with embodiments described herein, grounding link 200 may be configured to conductively connect to power cable 106 and bushing 111 via second T-end 110 and second bore 116.

Figure 2B:
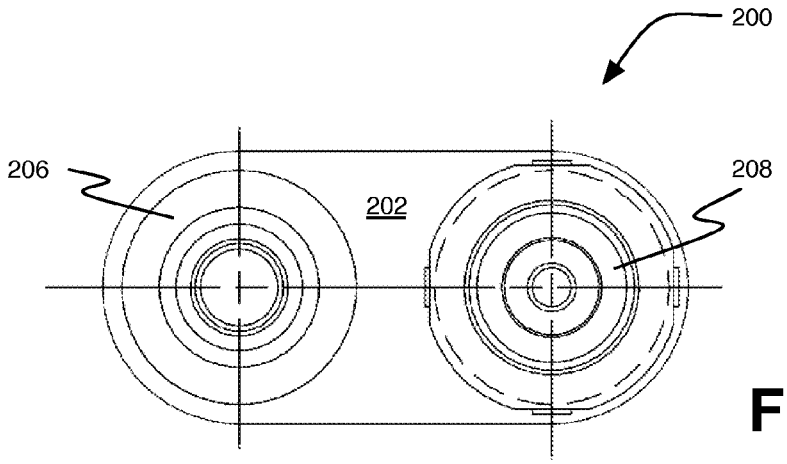
FIGS. 2A and 2B are cross-sectional side and top views, respectively, of the grounding link of FIGS. 1A-1C.
Figure 2A:
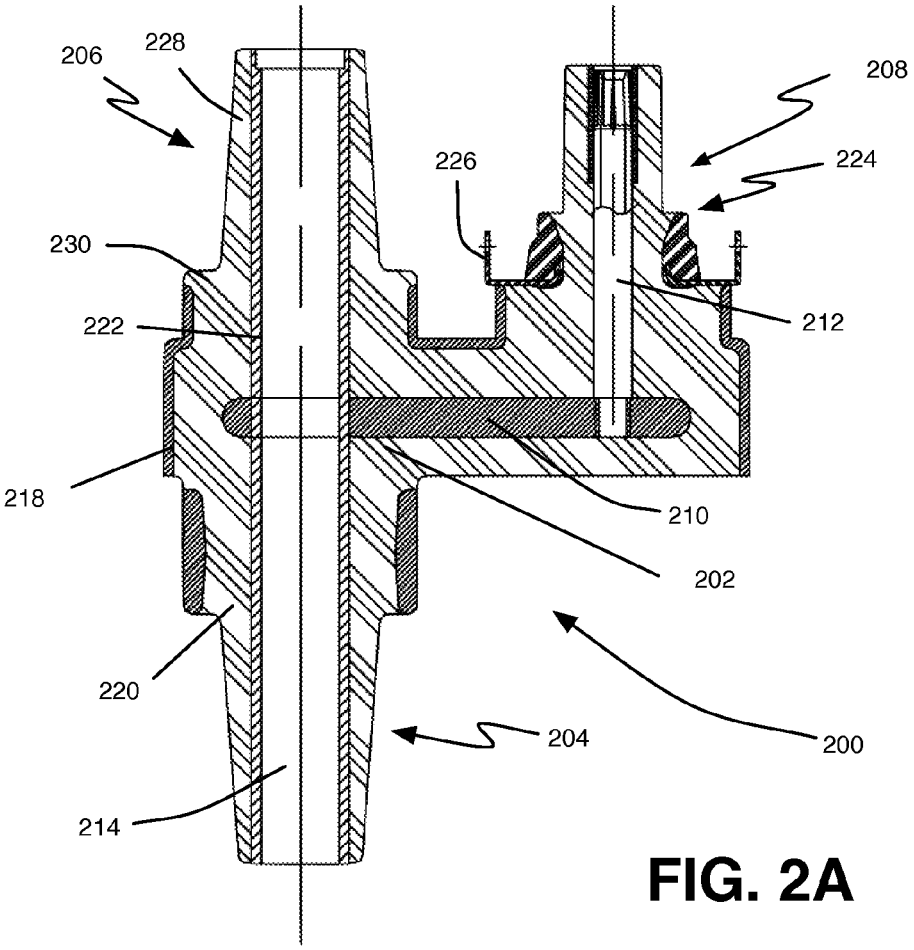
Figure 2C:
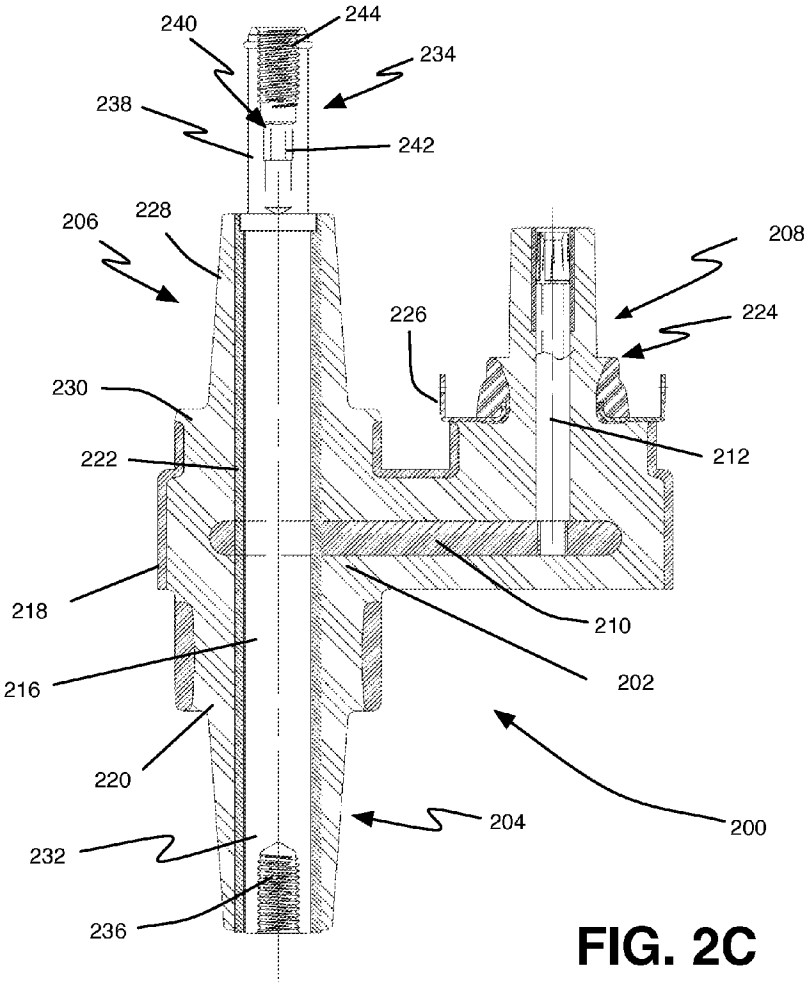
FIG. 2C is another cross-sectional side view of the grounding link of FIGS. 1A-1C.

FIG. 2A is a cross-sectional view of an embodiment of grounding link 200 consistent with implementations described herein. FIG. 2B is a top view of grounding link 200. FIG. 2C is a cross-sectional view of grounding link 200 into which grounding element 216 has been inserted.

As shown in FIGS. 2A and 2C, grounding link 200 may include a link body 202 that includes elbow interface bushing portion 204, insulated cap receiving portion 206, and tap interface portion 208. Grounding link 200 may further include conductive bus bar 210, a tap conductor portion 212, and bore 214 extending between interface bushing portion 204 and cap receiving portion 206 for receiving grounding element 216, as shown in FIG. 2C.

In general, grounding link 200 may be configured to provide a conductive link between second T-end 110 on elbow connector assembly 100 and both a grounding element 216 received within bore 214 (described in detail below) and tap conductor portion 212 via bus bar 210. In an exemplary implementation, link body 202 may include an electrically conductive outer shield 218 formed from, for example, a conductive or semi-conductive peroxide-cured synthetic rubber (e.g., EPDM). In other implementations, at least a portion of grounding link 200 may be painted with conductive or semi-conductive paint to form shield 218. Within shield 218, grounding link 200 may include an insulative inner housing 220, typically molded from an insulative rubber or epoxy material. Within insulative inner housing 220, grounding link 200 may include a conductive insert 222 that surrounds, or at least partially surrounds bore 214. For example, insert 222 may be formed of copper or other conductive metal and may function to conductively couple bore 214 to bus bar 210.

As shown in FIG. 1B, interface bushing portion 204 of grounding link 200 is configured (e.g., tapered or conically shaped) to be received within bore 116 in second T-end 110 during assembly of grounding link 200 onto elbow connector assembly 100.

As shown in FIG. 2A, tap conductor portion 212 of grounding link 200 is configured to be conductively coupled to bore 214/insert 222 (and grounding element 216 received therein) via bus bar 210 extending therebetween and embedded within insulative inner housing 220 of link body 202. In particular, tap conductor portion 212 may be configured to extend substantially perpendicularly from bus bar 210. An exposed end of tap conductor portion 212 (i.e., extending from a body 202) may be provided within tap interface portion 208 for engaging another device, such as an elbow connector 150, as shown in FIGS. 1A and 1B, and insulated cap 170, as shown in FIG. 1C, depending on the operational state of grounding link 200 (described below).

As shown in FIGS. 2A and 2C, tap interface portion 208 may include a stepped configuration 224 for engaging connector 150 and cap 170. Further, as shown in FIGS. 2A and 2C, stepped configuration 224 may include a conductive or semi-conductive material to insure electric continuity on exposed surfaces of assembly 100

For deadbreak embodiments, such as that shown in the figures, a bail securing element 226 may be provided in a surrounding relationship to tap interface portion 208 for engaging a bailing element 152 to secure elbow 150 to grounding link 200, as shown in FIG. 1B. Consistent with embodiment described herein, a loadbreak interface on tap interface portion 208 may also be provided. Consistent with embodiments described herein, tap interface portion 208 may comprise a reducing tap for provided a 200 amp interface to a 600 amp elbow connector 100.

Insulated cap receiving portion 206 of body 202 may include a tapered portion 228 and a base portion 230. Tapered portion 228 projects from base portion 230 in an axial direction away from bushing interface portion 204 and includes a tapered configuration for receiving a cavity 308 in insulated cap 300 (described below).

As shown in FIG. 2C, grounding element 216 includes a substantially cylindrical configuration shaped for insertion into bore 214 within link body 202 between interface bushing portion 204 and cap receiving portion 206. As shown in FIG. 2C, when inserted within link body 202, grounding element is conductively coupled with bus bar 210 via conductive insert 222. Grounding element 216 includes a stud receiving end 232 and a clamp engaging end 234 that projects beyond an end of insulated cap receiving portion 206 when installed within link body 202. Grounding element 216 may be formed of a conductive material, such as copper, brass, steel, or aluminum and, upon assembly, may conductively couple with power cable 106 and bushing 112 via stud portion 122.

In one embodiment, stud receiving end 232 may include a threaded opening 236 for matingly engaging corresponding threads on stud portion 122 of bushing 111, although other means for coupling with stud portion 122 may be incorporated, such as a push or snap-on connection, etc. Furthermore, in some implementations, the male/female relationship of stud portion 122 and stud receiving end 232 may be reversed.

As shown in FIG. 2C, clamp engaging end 234 includes a clamp engaging outer surface 238 and a multi-function bore 240 formed axially therein. As shown, clamp engaging outer surface 238 extends beyond an end of tapered portion 228 of insulated cap receiving portion 206. As described in detail below, clamp engaging outer surface 238 provides an engagement surface for engaging a hot line clamp or other suitable ground clamp device. Although clamp engaging outer surface 238 is depicted in FIG. 2C as having a smooth configuration, in other implementations, clamp engaging outer surface 238 may be provided with a high friction surface, such as a grooved or knurled surface to facilitate secure clamping.

Multi-function bore 240 extends axially within clamp engaging end 234 of grounding element 216 and includes a grounding link attachment portion 242 and cap securing portion 244. As shown in FIG. 2C, grounding link attachment portion 242 of multi-function bore 240 may be formed on the interior of multi-function bore 240 and includes a tool engaging configuration for receiving a tool, such as a hex wrench, therein.

During installation of grounding link 200, assume that power cable 106 is installed within elbow connector 100 and first T-end 108 of elbow connector 100 is installed onto bushing 111. At this point, elbow interface bushing portion 204 of grounding link 200 is inserted into bore 116 in second T-end 110 and grounding element 216 is inserted into bore 204 such that stud receiving end 232 of grounding element 216 engages stud 122 projecting through a corresponding portion of power cable 106 (e.g., a spade connector (not shown). Threaded opening 236 in grounding element 216 may be threaded onto stud portion 122 of bushing 111 and secured using a suitable tool via multi-function bore 240 engaged with grounding link attachment portion 242. Although grounding link attachment portion 242 is depicted in FIG. 2A as including a hexagonal surface configuration, in other embodiments, different types of tool engaging configurations may be used, such as flat or Phillips head configurations, a Torx configuration, a 12-sided configuration, etc.

Figure 3:
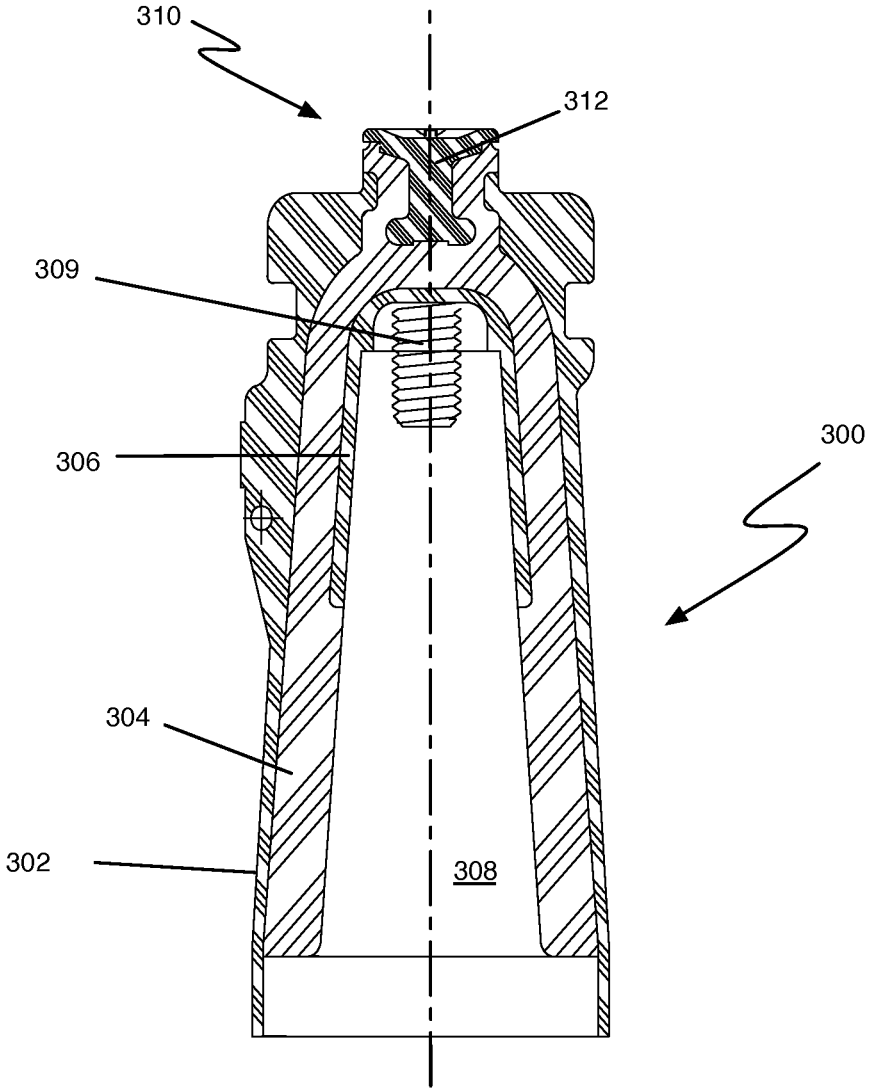
FIG. 3 is a cross-sectional side view of the insulated cap of FIGS. 1A and 1B.

As shown in FIG. 2C, cap securing portion 244 of multi-function bore 240 may include an internally threaded configuration for use in securely retaining insulated cap 300 (shown in FIGS. 1A and 1B). FIG. 3 is a cross-sectional view of an exemplary insulated cap 300. As shown, insulated cap 300 may include an outer conductive or semi-conductive shield 302, an insulative inner housing 304, typically molded from an insulative rubber or epoxy material, and a conductive or semi-conductive insert 306 that surrounds clamp engaging end 234 of grounding element 216 once insulated cap 300 is installed on insulated cap receiving portion 206 of grounding link 200.

As shown in FIG. 3, insulated cap 300 includes a substantially conical cavity 308 formed therein for receiving clamp engaging end 234 and tapered portion 228 of grounding link 200. As described briefly above, the conical configuration of cavity 308 corresponds to the tapered configuration of tapered portion 228 to allow insulated cap 300 to become seated on grounding link 200 during installation. Furthermore, as shown in FIG. 3, insulated cap 300 may include an engagement stud 309 having a threaded outer surface for engaging threaded cap securing portion 244 of multi-function bore 240 in grounding element 216. During assembly, engagement stud 309 may be threaded into cap securing portion 244 and tightened to secure insulated cap 300 to grounding link 200.

In one exemplary implementation, insulated cap 300 may include a voltage detection test point assembly 310 for sensing a voltage in connector assembly 100. Voltage detection test point assembly 310 may be configured to allow an external voltage detection device to detect and/or measure a voltage associated with elbow connector assembly 100.

For example, as illustrated in FIG. 3, voltage detection test point assembly 310 may include a test point terminal 312 embedded in a portion of insulative inner housing 304 of insulated cap 300 and extending through an opening within outer shield 302. In one exemplary embodiment, test point terminal 312 may be formed of a conductive metal or other conductive material. In this manner, test point terminal 312 may be capacitively coupled to grounding element 216 upon installation of insulated cap 300 on grounding link 200.

As shown in FIGS. 1A and 1B, a test point cap 314 may sealingly engage an exposed portion of test point terminal 312 and outer shield 302 of insulated cap 300. In one implementation, test point cap 314 may be formed of a semi-conductive material, such as EPDM. When test point terminal 312 is not being accessed, test point cap 314 may be mounted on test point assembly 310. Because test point cap 314 is formed of a conductive or semiconductive material, test point cap 314 may ground test point assembly 310 when in position. Test point cap 314 may include an aperture 316 for facilitating removal, e.g., using a hooked lineman's tool, etc.

When it is desired to perform work on a particular line or switchgear component, it is necessary to ensure that the system is properly de-energized and grounded before work can begin. Consistent with embodiments described herein, to accomplish this, a technician first tests connector 100, e.g., using voltage detection test point assembly 310, to ensure that connector 100 has been de-energized. If the test indicates that the connector 100 is de-energized, elbow connector 150 may be removed from tap interface portion 208 (e.g., by removing bailing element 152) and replaced with insulated cap 170. Next, insulated cap 300 is removed (e.g., by unscrewing) from grounding link 200. As shown in FIG. 1C, after removal of insulated cap 300 from grounding link 200, clamp engaging end 234 of grounding element 216 is exposed.

Figure 4:
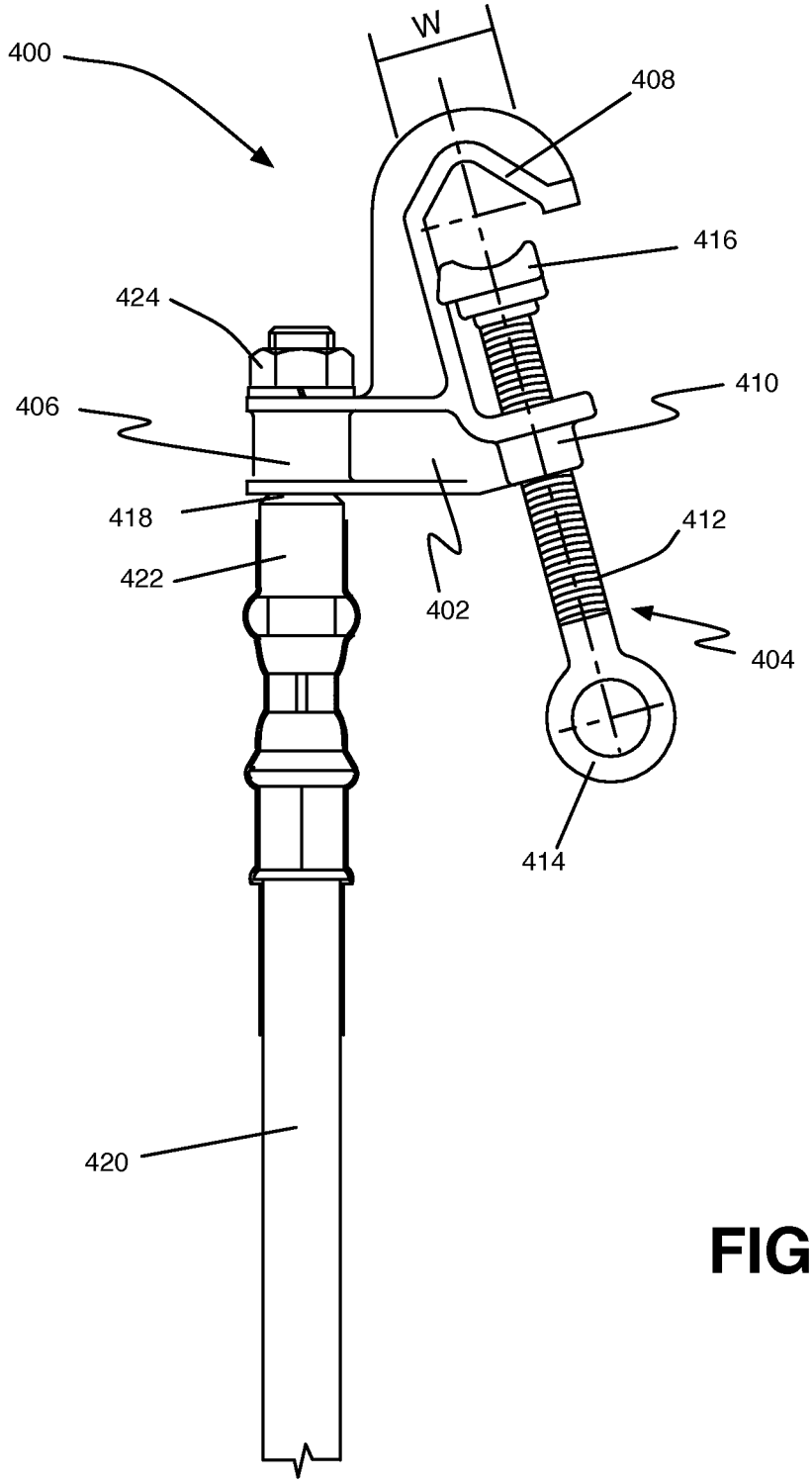
FIG. 4 is a schematic side view of an exemplary hot line clamp.

FIG. 4 is a schematic side view of an exemplary hot line clamp 400. FIG. 2C is a schematic side view of hot line clamp 400 coupled to grounding link 200 in a manner consistent with embodiments described herein.

Referring to FIG. 4, in one exemplary implementation, hot line clamp 400 includes a conductive body 402, a clamping member 404, and a ground line attachment portion 406. Conductive body 402 may be formed of a conductive metal, such as brass or aluminum and may include a generally v or c-shaped region 408 for receiving a portion of clamp engaging end 234 of grounding element 216. For example, a width "W" may be substantially similar, yet slightly larger than an outside diameter of clamp engaging end 140. With such a configuration, v-shaped region 408 may easily slip onto exposed clamp engaging end 140 following removal of insulated cap 300.

As shown in FIG. 4, conductive body 402 may include an opposing portion 410 projecting from body 402 in a location opposing v-shaped region 408. Opposing portion 410 includes a threaded aperture therethrough configured to receive clamping member 404, such that clamping member is positioned in clamping relation to v-shaped region 408.

Clamping member 404, in one exemplary embodiment, includes a generally cylindrical, threaded body 412 having a tool engaging portion 414 on one end and a part engagement portion 416 on an opposing end, distal from tool engaging portion 414. During assembly of hot line clamp 400, body 412 is threaded through opposing portion 410 such that part engagement portion 416 opposes v-shaped region 408.

As shown in FIG. 1C, during connection of hot line clamp 400 to elbow connector grounding link 200, v-shaped region 408 of conductive body 402 is placed over the exposed clamp engaging end 234 of ground element 216. Tool engaging portion 414 of clamping member 404 is then rotated, e.g., using a lineman's hook, causing part engaging portion 416 to travel toward v-shaped region 408, thus securing clamp engaging end 140 of grounding link 200 within hot line clamp 400.

Returning to FIG. 4, conductive body 402 of hot line clamp 400 also includes an aperture 418 for receiving ground line attachment portion 406. Ground line attachment portion 406 may include a mechanism for securing a ground line 420 to, for example, a threaded lug 422. In one implementation, ground line attachment portion 406 may include a crimp style connector for securing ground line 420 to lug 422. As shown in FIG. 4, lug 422 may be inserted into aperture 418 in conductive body 402 and secured using nut 424.

Embodiments described herein increase the efficiency with which work may be performed on a power line or switchgear component by providing an efficient means for grounding elbow connector 100 without requiring disassembly of the connector or replacement of the connector with a single-purpose grounding component. Rather, grounding link 200 is maintained within elbow connector 100 for use when needed. When grounding is not needed, insulated cap 300 may be reinstalled and power cable elbow connector assembly 100 may operate in a conventional manner.

Figure 5A:
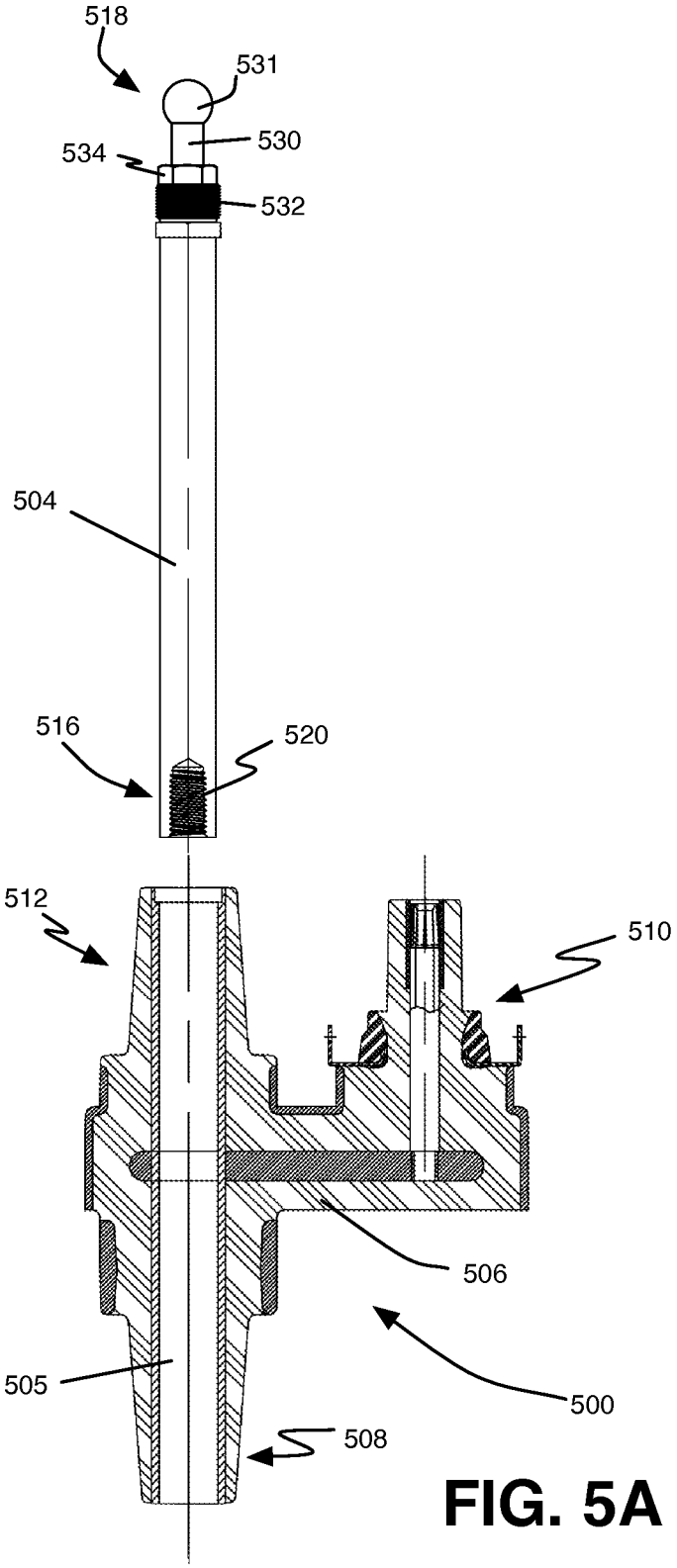
FIGS. 5A-5D are cross sectional/side view illustrations of another exemplary grounding link consistent with embodiments described herein.
Figure 5B:
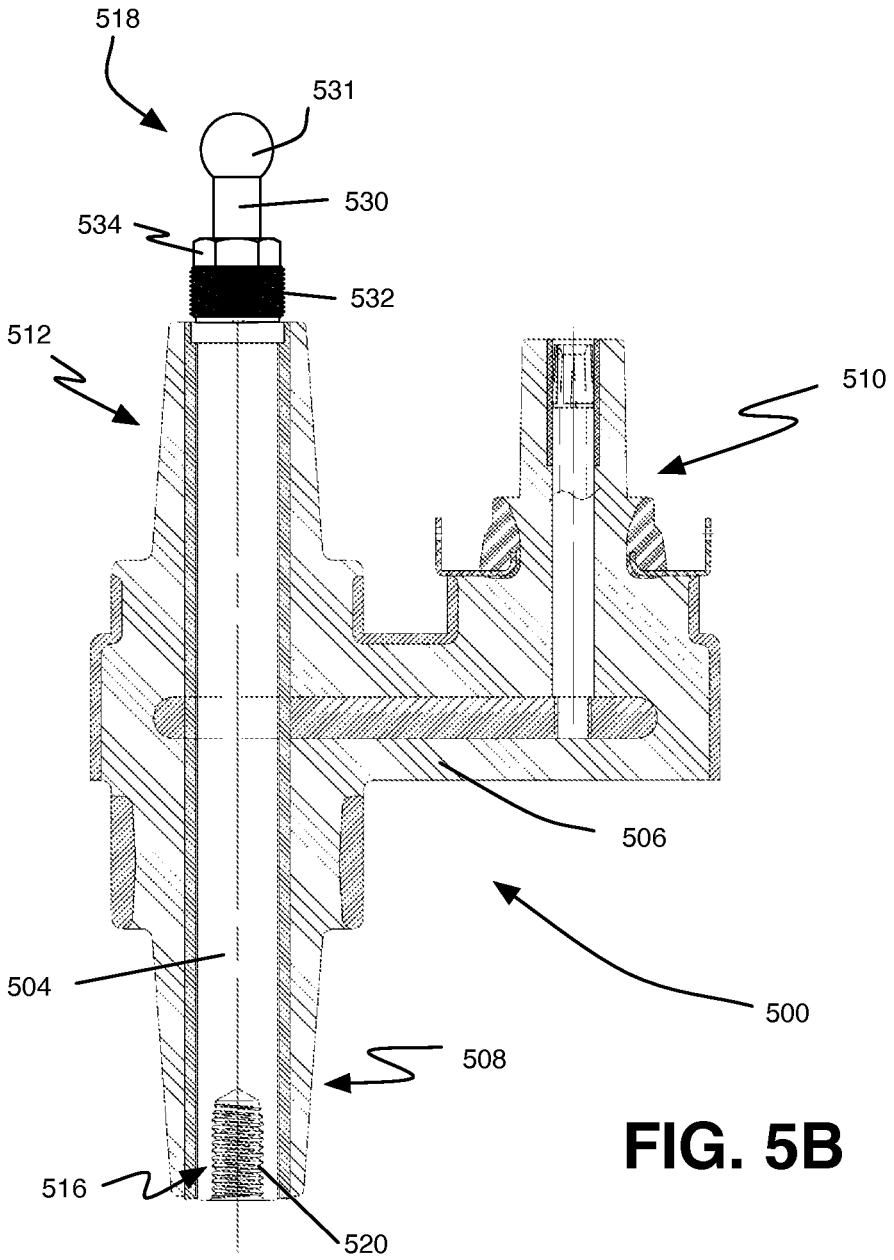
Figure 5C:
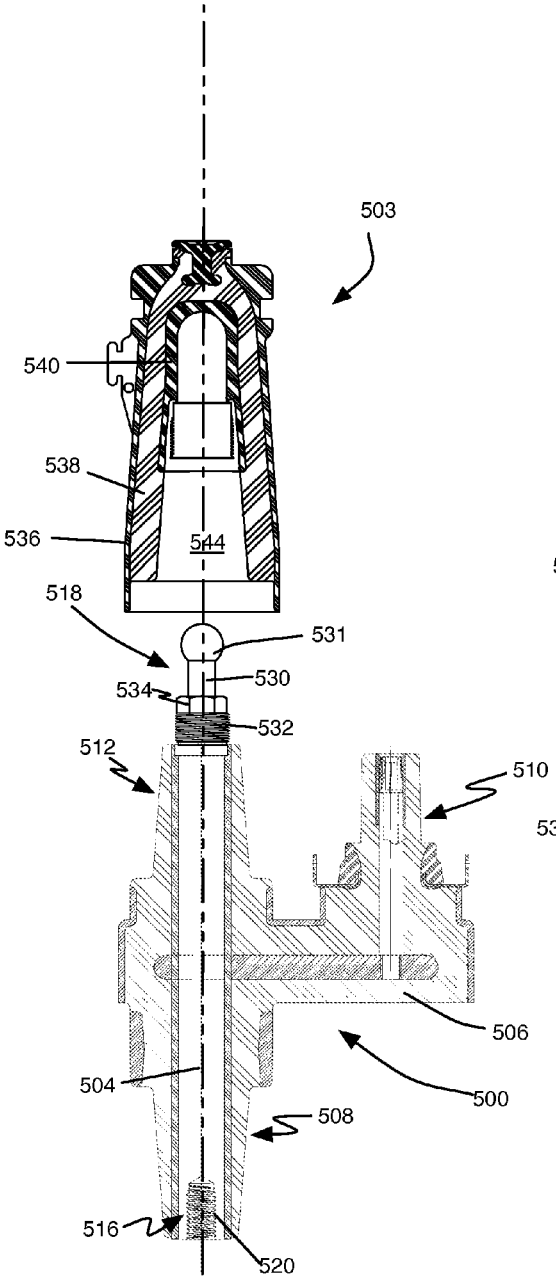
Figure 5D:
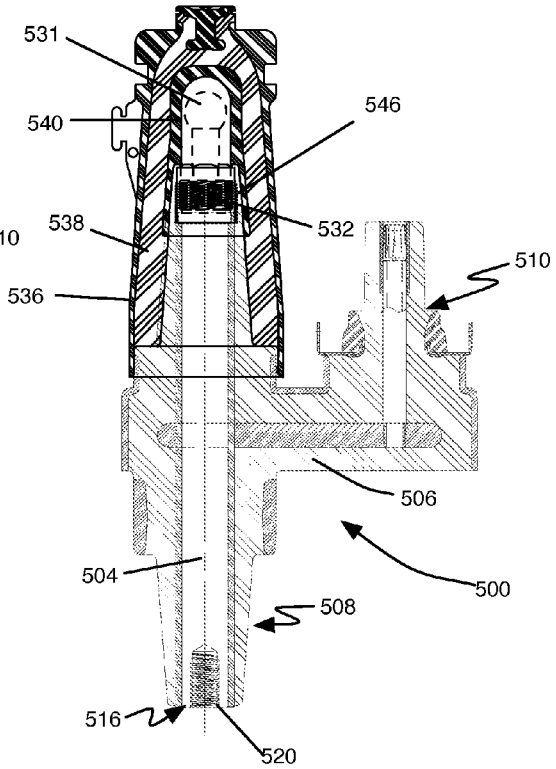

FIGS. 5A-5D are cross sectional/side view illustrations of another exemplary grounding link 500 consistent with embodiments described herein. In particular, FIG. 5A is a cross-sectional diagram illustrating an exemplary grounding link 500 and grounding element 504 in a pre-assembled configuration. FIG. 5B is a side view of grounding link 500 and grounding element 504 in an assembled configuration. FIG. 5C is a side view of grounding link 500 further illustrating (in cross-section) an exemplary insulating cap 503 positioned for assembly on grounding link 500. FIG. 5D is a side view of grounding link 500 and grounding element 504 showing insulating cap 503 installed on grounding interface end 518.

Consistent with embodiments described herein, grounding link 500, similar to grounding link 200 described above in relation to FIGS. 2A-2C, includes a grounding element 504 positioned within a bore 505 in insulated body 506. Similar to grounding link 200 described above, grounding link 500 includes a bushing interface portion 508 for engaging second T-end in connector 100, a tap portion 510 for receiving an elbow connector or insulated cap, such as connector 150 and cap 170 illustrated in FIGS. 1A-1C and described above, and a cap receiving portion 512 for receiving an insulated cap, such as insulated cap 503 described below.

As shown in FIG. 5A, grounding element 504 includes a stud receiving end 516 and a grounding interface end 518. Grounding element 504 may be formed of a conductive material, such as brass, steel, or aluminum and, upon assembly, may conductively couple with power cable 106, bushing 112, and tap portion 510 via an integrated bus bar (not shown) similar to that described above in relation to FIG. 2A.

In one embodiment, stud receiving end 516 includes a threaded opening 520 for matingly engaging corresponding threads on a bushing, such as bushing 111 described above. However, in other embodiments, other means for coupling with the bushing may be incorporated, such as a push or snap-on connection, etc.

As shown in FIG. 5A, grounding interface end 518 includes a conductive body 530 having a ball end 531, designed to engage with a suitably sized ball socket clamp, such as ball socket clamp 600 described in relation to FIG. 6, below. Conductive body 530 of grounding interface end 518 includes a threaded portion 532 configured to engage an interior portion of cap 503, as described below, and a tool engaging portion 534 configured to enable grounding element 504 secure grounding link 500 to bushing 111 using, for example, a wrench or hexagonal socket. As shown in FIG. 5A, threaded portion 532 is positioned below tool engaging portion 534 (relative to ball end 531) and includes an outside diameter greater than an outside diameter of tool engaging portion 534.

In some embodiments, conductive body 530, ball end 531, threaded portion 532, and tool engaging portion 534 may be formed as one element of conductive material, such as copper, brass, steel, or aluminum. In other implementations, one or more of these components may be formed separately and secured to conductive body 530, such as via welding, etc.

During installation, grounding element 504 may be inserted within bore 505 in grounding link 500 between bushing interface portion 508 and cap receiving portion 512 grounding link 500, as shown in FIG. 5B. Grounding link 500 in then inserted into bore 116 in second T-end 110 of connector 100. Threaded opening 520 in stud receiving end 516 in grounding element 504 may be threaded onto stud portion 122 of bushing 111. A suitable tool is then used to engage tool engaging portion 534 to secure grounding link 500 to elbow assembly 100.

When it is no longer necessary to ground connector 100, insulating cap 503 is installed over grounding interface end 518 and cap receiving portion 512 and secured via threaded portion 532 of grounding element 504, as shown in FIG. 5D and described below.

As shown in FIG. 5C, in one embodiment, insulated cap 503 includes an outer conductive or semi-conductive shield 536, an insulative inner housing 538, typically molded from an insulative rubber or epoxy material, a conductive or semi-conductive insert 540, and an engagement portion 542. Conductive or semi-conductive insert 540 is configured to surround ball end 531 of grounding interface end 518 when insulated cap 503 is installed on grounding link 500.

As shown in FIGS. 5C and 5D, insulated cap 503 includes a substantially conical cavity 544 formed therein for receiving ball end 531 and second tapered portion 512 of grounding device 500. The conical configuration of cavity 544 generally corresponds to the tapered configuration of cap receiving portion 512 to allow insulated cap 503 to become seated on grounding link 500 during installation.

As shown in FIGS. 5C and 5D, engagement portion 542 may include internal threads 546 for engaging threaded portion 532 of grounding element 504. In one implementation, engagement portion 542 may be formed of a rigid material (e.g., plastic or metal) and may be press-fit into a recess formed into insert 540. In other embodiments, engagement portion 542 may be secured to insert 540 for other means, such as an adhesive, etc. During assembly, as shown in FIG. 5D, the threads 546 of engagement portion 542 of insulated cap 503 may be threaded into threaded portion 532 and tightened (e.g., by hand) to secure insulated cap 503 to grounding device 500.

Although not shown in FIGS. 5A-5D, in some embodiments insulated cap 503 may include a voltage detection test point assembly, a test point cap, and/or a bailing assembly similar to those described above with respect to FIGS. 1A-2.

It should be noted that, although FIGS. 5A-5D depict grounding element 504 as a unitary/integrated element, in other implementations consistent with embodiments described herein, these elements may be formed as discrete core and interface end components, secured together in any suitable manner, such as a threaded interface, welding, snap or push-on, etc.

Figure 6:
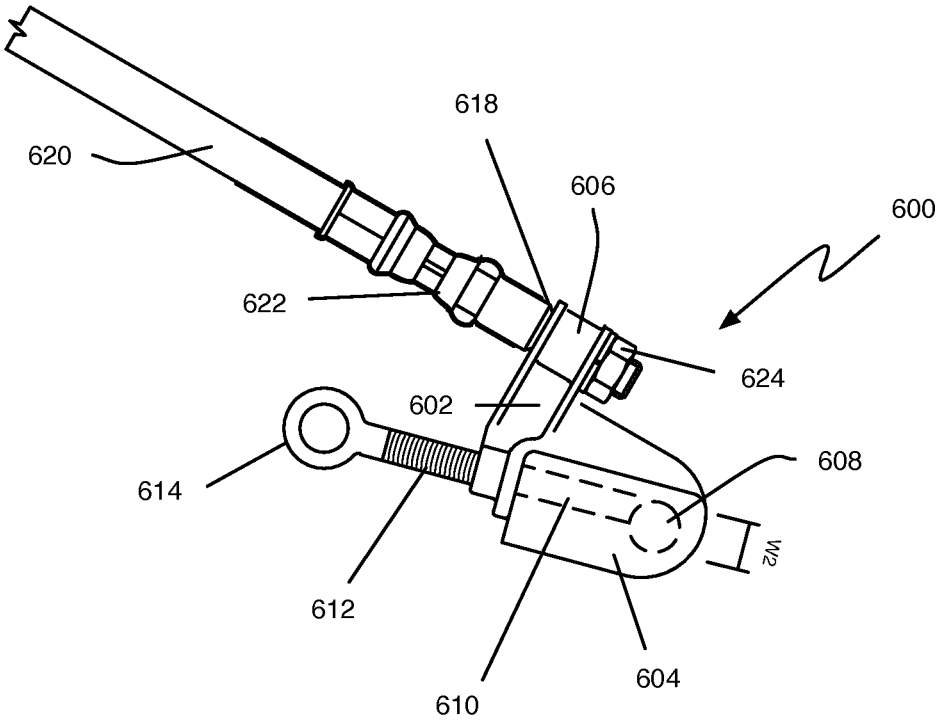
FIG. 6 is a schematic side view of an exemplary ball socket clamp for use with embodiments consistent with FIGS. 5A-5D.

FIG. 6 is a side view of an exemplary ball socket clamp 600 for use with the embodiment described in FIGS. 5A-5D above. As shown, ball socket clamp 600 includes a conductive body 602, a clamping member 604, and a ground line attachment portion 606. Conductive body 602 may be formed of a conductive metal, such as brass or aluminum and may include a socket portion 608 formed therein for receiving ball end 531 of grounding element 504. For example, a width "W2" may be substantially similar, yet slightly larger than an outside diameter of ball end 531. With such a configuration, socket portion 608 may easily slip onto exposed ball end 531 following installation of grounding link 500 into elbow connector 100.

As shown in FIG. 6, conductive body 602 may include a threaded aperture 610 for receiving clamping member 604, such that clamping member 604 is positioned in clamping relation to socket portion 608. Clamping member 604, in one exemplary embodiment, includes a generally cylindrical, threaded body 612 having a tool engaging portion 614 on one end and a ball engaging portion (not shown) on an opposing end, distal from tool engaging portion 614. During assembly of ball socket clamp 600, body 612 is threaded through aperture 610 such that the ball engaging portion engages ball end 531 of grounding element 504.

During connection of ball socket clamp 600 to grounding element 504, socket portion 608 of conductive body 602 is placed over exposed ball end 531 of grounding element 504. Tool engaging portion 614 of clamping member 604 is then rotated, e.g., using a lineman's hook, causing the ball engaging portion to travel toward socket portion 608, thus securing ball end 531 within ball socket clamp 600.

As shown in FIG. 6, conductive body 602 of ball socket clamp 600 also includes an aperture 618 for receiving ground line attachment portion 606. Ground line attachment portion 606 may include a mechanism for securing a ground line 620 to, for example, a threaded lug 622. In one implementation, ground line attachment portion 606 may include a crimp style connector for securing ground line 620 to lug 622. Lug 622 may be inserted into aperture 618 in conductive body 602 and secured using nut 624.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, although grounding element 504 of grounding link 500 has been illustrated and described in terms of ball end 531, and grounding element 216 of grounding link 200 has been illustrated and described in terms of a cylindrical, clamp engaging end 234, in other embodiments difference configurations may be implemented in a manner consistent with the described features. For example, different configurations of clamp engaging surfaces may be implemented.

Implementations may also be used for other devices, such as other high voltage switchgear equipment, such as any 15 kV, 25 kV, or 35 kV equipment. For example, various features have been mainly described above with respect to elbow power connectors. In other implementations, other medium/high voltage power components may be configured to include the grounding assemblies described herein, such as yokes, taps, etc.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical connector assembly, comprising:

a connector body comprising:

a conductor receiving end;

a first connector end formed substantially perpendicularly to an axial direction of the conductor receiving end, wherein the first connector end includes a first axial bore configured to receive a bushing element therein; and a second connector end formed substantially perpendicularly to the axial direction of the conductor receiving end and opposing the first connector end, wherein the second connector end includes a second axial bore formed therein; and a grounding link having a bushing interface portion, a cap receiving portion, and a tap portion, wherein the grounding link further includes a grounding element extending between the bushing interface portion and the cap receiving portion, wherein the bushing interface portion of the grounding link is configured for insertion into the second axial bore of the second connector end, wherein the grounding element includes an exposed portion projecting above a surface of the grounding link, wherein the exposed portion of the grounding element is configured for attachment by a grounded hot line clamp to ground the electrical connector assembly; and wherein the tap portion is electrically coupled to the grounding element and configured for engagement with another, separate connector device.

2. The electrical connector assembly of claim 1, wherein the second axial bore in the second connector end includes a tapered configuration, and wherein the bushing interface portion of the grounding link includes a correspondingly tapered configuration for engaging the tapered configuration of the second axial bore.

3. The electrical connector assembly of claim 2, wherein the exposed portion of the grounding element projects from a surface of the cap receiving portion of the grounding link, wherein the cap receiving portion includes a tapered configuration.

4. The electrical connector assembly of claim 3, wherein the exposed portion of the grounding element comprises a generally cylindrical configuration for engaging clamping members of the hot line clamp.

5. The electrical connector assembly of claim 4, wherein the exposed portion comprises a multi-function bore formed axially therein, wherein the multi-function bore includes a grounding link attachment portion, and wherein, following insertion of the bushing interface portion of the grounding link into the second bore of the second connector end, the grounding link is secured within the second bore by application of a tool within the grounding link attachment portion of the multi-function bore.

6. The electrical connector assembly of claim 5, further comprising:

an insulated cap configured to cover the exposed portion of the grounding element when the electrical connector is in a non-grounded configuration.

7. The electrical connector assembly of claim 6, wherein the insulated cap comprises an insulated body and a securing element, wherein an insulated body of the insulated cap comprises a tapered cavity therein for receiving the second end of the insulated body of the grounding link, wherein the securing element of the insulated cap projects within the tapered cavity, wherein the multi-function bore includes a second cap-securing portion, and wherein, upon placement of the tapered cavity of the insulated cap on the tapered second end of the grounding link, the securing element is configured to engage the cap-securing portion of the multi-function bore.

8. The electrical connector assembly of claim 7, wherein the securing element comprises a threaded stud and wherein the cap-securing portion of the multi-function bore comprises a correspondingly threaded portion of the multi-function bore.

9. The electrical connector assembly of claim 4, wherein the exposed portion of the grounding element comprises a ball configuration for engaging a ball socket in the hot line clamp.

10. The electrical connector assembly of claim 9, wherein the exposed portion of the grounding element comprises a tool engaging portion and a cap securing portion, wherein, following insertion of the grounding link into the second bore of the second connector end, the grounding element is secured within the second bore by application of a tool to the tool engaging portion.

11. The electrical connector assembly of claim 2, wherein the grounding element comprises a second end for securing the grounding element and the grounding link to a bushing.

12. The electrical connector assembly of claim 1, wherein the connector body comprises a 600 amp connector and wherein the tap portion comprises a reducing tap interface portion for providing a 200 amp interface to the 600 amp connector.

13. A medium or high voltage power cable elbow connector assembly, comprising:

a connector body having a conductor receiving end, a bushing receiving end projecting substantially perpendicularly from the connector body, and a connection end projecting substantially perpendicularly from the connector body and oriented substantially opposite to the bushing receiving end, wherein the connector body includes a first axial bore that communicates with each of a second axial bore and a third axial bore in the bushing receiving and connection ends, respectively, and wherein the bushing receiving end is configured to receive a switchgear bushing therein;

a grounding link configured for insertion into the third axial bore of the connection end, wherein the grounding link is configured to conductively connect to the switchgear bushing, wherein the grounding link includes each of a cap receiving portion and a reducing tap portion, wherein the cap receiving portion is aligned with a bushing interface portion configured for insertion into the third axial bore;

a grounding element configured for insertion within a bore in the grounding link to conductively couple with the switchgear bushing in the third axial bore, wherein the grounding element comprises an exposed portion for engaging a grounded hot line clamp, during grounding of the electrical connector assembly, wherein the reducing tap portion of the grounding link is electrically coupled to the grounding element and configured to receive another connector device comprising an elbow connector having a reduced amperage; and an insulated cap configured to cover the exposed conductive portion of the grounding element during normal operation of the electrical connector assembly.

14. The medium or high voltage power cable elbow connector assembly of claim 13, wherein the exposed conductive portion of the grounding element comprises one of a cylindrical or ball configuration.

15. The medium or high voltage power cable elbow connector assembly of claim 13, wherein the exposed portion of the grounding element comprises a generally cylindrical configuration for engaging clamping members of the hot line clamp.

16. The medium or high voltage power cable elbow connector assembly of claim 15, wherein the exposed portion comprises a multi-function bore formed axially therein, wherein the multi-function bore includes a grounding link attachment portion, and wherein, following insertion of the bushing interface portion of the grounding link into the third axial bore, the grounding link is secured within the third axial bore by application of a tool within the grounding link attachment portion of the multi-function bore.

17. The electrical connector assembly of claim 13, wherein the connector body comprises a 600 amp connector and wherein the reducing tap portion comprises a 200 amp tap interface to the 600 amp connector.

18. A method, comprising:

connecting a bushing interface of a power cable elbow connector to a switchgear bushing, wherein the power cable elbow connector further comprises a connector body for receiving a power cable therein, and a connector end projecting from the connector body oppositely from the bushing interface, wherein the connector end includes an axial bore therein;

inserting a grounding link into the axial bore in the connector end, wherein the grounding link includes an insulated body, a tap portion, and a cap receiving portion, and wherein the grounding link comprises a grounding element extending therethrough, the tap portion being electrically coupled to the grounding element, wherein the grounding element is configured to couple with the bushing in the bushing interface and further includes an exposed conductive portion projecting from the cap receiving portion, and wherein the tap portion provides an amperage interface that is lower than an amperage interface provided by the exposed conductive portion of the grounding element;

installing a first insulated cap over the exposed conductive portion of the grounding element;

installing a reduced amperage elbow connector onto the tap portion of the grounding link;

energizing the power cable elbow connector;

de-energizing the power cable elbow connector;

removing the reduced amperage elbow connector from the tap portion of the grounding link;

installing a second insulated cap onto the tap portion;

removing the first insulated cap from the exposed conductive portion of the grounding element; and attaching a hot line clamp to the exposed conductive portion of the grounding element, wherein the hot line clamp is coupled to a ground line to ground the power cable elbow connector.

19. The method of claim 18, wherein the first insulated cap further comprises a voltage test point, the method further comprising:

testing a voltage of the power cable electrical connector via the voltage test point in the first insulated cap to determine whether the power cable elbow connector has been de-energized; and removing the first insulated cap when it is determined that the power cable elbow connector has been de-energized.

* * * * *